US006626335B1

(12) United States Patent
Dunlop

(10) Patent No.: US 6,626,335 B1
(45) Date of Patent: Sep. 30, 2003

(54) COMFORTABLE GUITAR SHOULDER STRAP

(75) Inventor: James Andrew Dunlop, Benicia, CA (US)

(73) Assignee: Dunlop Manufacturing, Inc., Benicia, CA (US)

( * ) Notice: Subject to any disclaimer, the term of this patent is extended or adjusted under 35 U.S.C. 154(b) by 201 days.

(21) Appl. No.: 09/933,403

(22) Filed: Aug. 20, 2001

(51) Int. Cl.[7] ..... G10D 3/00

(52) U.S. Cl. ..... 224/258; 224/643; 224/910; 84/327

(58) Field of Search ..... 224/258, 257, 224/600, 607, 610–614, 617, 910, 643, 642, 913, 901.4, 616–622, 158; 150/110; 84/327; 24/302; 2/338, 920, 275

(56) References Cited

U.S. PATENT DOCUMENTS 2,008,759 A * 7/1935 Howard ..... 224/613
2,146,772 A * 2/1939 Sichere ..... 2/338
2,539,677 A * 1/1951 Teare ..... 602/4
3,323,698 A * 6/1967 Sottile ..... 224/910
3,688,012 A * 8/1972 Vettel ..... 84/327
4,047,651 A * 9/1977 McMullen ..... 224/901.4
4,148,423 A * 4/1979 Schlacher ..... 224/910
4,291,822 A * 9/1981 Simonds ..... 224/910
4,858,801 A * 8/1989 Sameniego ..... 224/910
5,070,866 A * 12/1991 Alexander et al. ..... 2/920
D335,136 S 4/1993 McMichael
5,255,833 A * 10/1993 McAllister ..... 150/110
5,388,743 A 2/1995 Silagy
6,076,789 A * 6/2000 Jackson ..... 224/901.4
6,095,389 A * 8/2000 Fenton et al. ..... 224/600

* cited by examiner

*Primary Examiner*—Nathan J. Newhouse
(74) *Attorney, Agent, or Firm*—Robert Charles Hill

(57) ABSTRACT

A guitar shoulder strap incorporates thickened, rolled edges along the length of the strap. The strap webbing between is generally about two millimeters thick and fifty millimeters wide. The thick, rolled edges are almost four millimeters thick and about six millimeters wide. A decorative pattern is weaved into the outside decorative surface. The strap webbing and thick, rolled edges are a single weave of textile wherein many longitudinal fibers have been bunched into cords at the edges and spiraling transverse fibers are woven to build the webbing and encase the cords.

1 Claim, 1 Drawing Sheet

Fig. 3
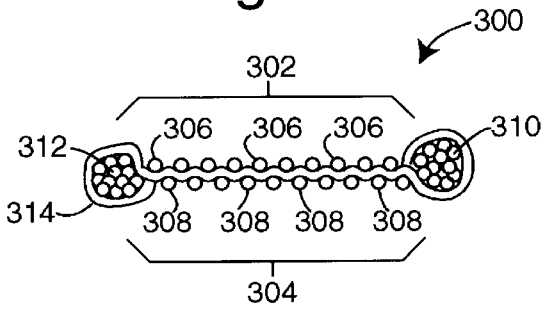
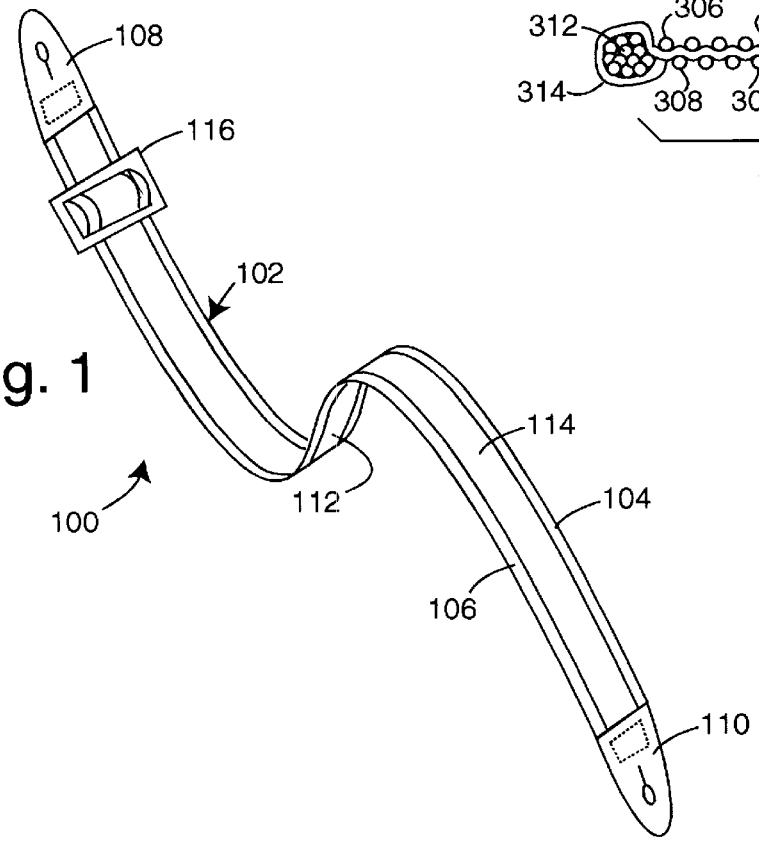
Fig. 1
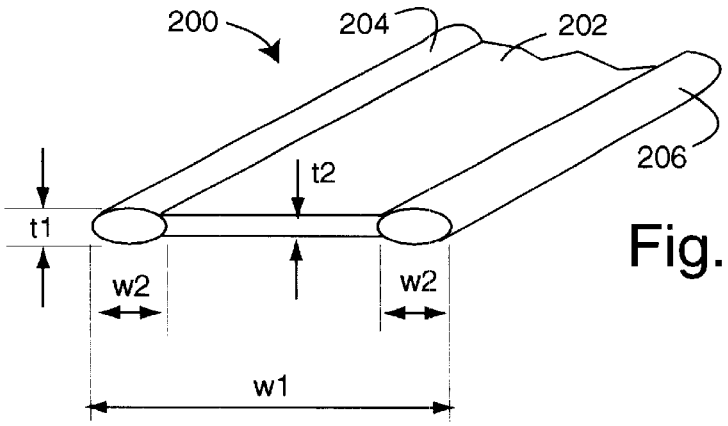
Fig. 2

COMFORTABLE GUITAR SHOULDER STRAP

BACKGROUND OF THE INVENTION

1. Field of the Invention

The present invention relates to shoulder straps, and more particularly to shoulder straps used to support guitars and other instruments over the shoulder of a user in a sling.

2. Description of Related Art

The way guitars are usually played does not allow for two-handed support of the instrument while standing. The user's left hand grips the fret board neck, and the right hand is used only to strum the strings with the fingers or a pick. Sometimes the palm of the right hand can be used to press the guitar body tight against the hip of the user, but this position is awkward and tiring. So, unless the user is sitting, the bottom end of the guitar at the user's right is conventionally supported at a comfortable height with a sling strap so the strings can be strummed easily.

Guitars are a favorite amongst musical groups and bands, and the guitarist is usually out in front with a maximum of public exposure. So it has been customary to decorate both the guitars and their straps with a variety of colorful patterns.

Long periods of use can cause prior art guitar shoulder straps to "cut" into the user's shoulder and become sore. Various ways have been devised to combat this problem. Howard Silagy describes a Shoulder Pad for Decorative Guitar Strap in U.S. Pat. No. 5,388,743, issued Feb. 14, 1995. A standard guitar shoulder strap is threaded through the slots of a wider shoulder pad and helps spread the weight the user's shoulder. The pad is especially placed on the collar bone area and other bony areas of the shoulder that are easily irritated and made sore by straps with heavy loads. Howard Silagy further describes and diagrams, e.g., FIG. 4, a strap pad in cross-sectional view which has edges that are narrower in thickness than the webbing in between.

SUMMARY OF THE INVENTION

Briefly, a guitar shoulder strap embodiment of the present invention incorporates thickened, rolled edges along the length of the strap. The strap webbing between is generally about two millimeters thick and fifty millimeters wide. The thick, rolled edges are almost four millimeters thick and about six millimeters wide. A decorative pattern is weaved into the outside decorative surface. The strap webbing and thick, rolled edges are a single weave of textile wherein many longitudinal fibers have been bunched into cords at the edges and spiraling transverse fibers are woven to build the webbing and encase the cords.

An advantage of the present invention is that a strap is provided that is comfortable to wear.

Another advantage of the present invention is that a strap is provided that is attractive and marketable.

Another advantage of the present invention is the change is incorporated into the strap itself and is not another part that might be separated from the strap.

Another advantage of the present invention is that the design change is incorporated into the full length of the strap and not one section, making it effective to not only the shoulder but any area of the body that might bear the weight of the guitar.

A further advantage of the present invention is that a guitar shoulder strap is provided that can be economically manufactured.

The above and still further objects, features, and advantages of the present invention will become apparent upon consideration of the following detailed description of specific embodiments thereof, especially when taken in conjunction with the accompanying drawings.

BRIEF DESCRIPTION OF THE DRAWINGS

FIG. 1 illustrates a guitar shoulder strap embodiment of the present invention;

FIG. 2 represents a guitar shoulder strap in cross-section, in one embodiment of the present invention; and FIG. 3 represents a guitar shoulder strap in cross-section that has been fabricated from a single textile weave in a preferred embodiment of the present invention.

DETAILED DESCRIPTION OF THE INVENTION

FIG. 1 illustrates a guitar shoulder strap embodiment of the present invention, referred to herein by the reference numeral 100. The guitar shoulder strap 100 comprises a thin, flat strip of material 102 with two thicker ridges 104 and 106 at opposite outside edges. A pair of button-loops 108 and 110 are provided at the two opposite ends and secure to standard button fasteners found on ordinary guitars. An inside wear surface 112 provides a comfortable contact over the shoulder of a user. An outside decorative surface 114 is intended be attractive, e.g., during a performance on-stage. An adjustment buckle 116 allows the user to change how low the strap slings a guitar over the shoulder.

A thickened material along both of the two opposite outside edges causes a protrusion in the pair of ridges 104 and 106 along the two opposite outside edges of the inside wear surface. Preferred embodiments are made from a single woven fabric, while the button-loops 108 and 110 are made of leather and the buckle 116 is hard plastic. A single weave of textile has transverse fibers that spiral in loops along the entire length, and the transverse fibers are interwoven with a first set of longitudinal fibers. The first set of longitudinal fibers include a decorative pattern on the decorative surface, and the transverse fibers loop at the opposite outside edges around respective bunches of a second and third set of longitudinal fibers to create opposite thick rolled edges. Many longitudinal fibers can be bunched into cords at the edges and the single spiraling transverse fibers are woven to build the webbing and encase the cords.

FIG. 2 represents a guitar shoulder strap 200 in cross-section, in one embodiment of the present invention. The strap 200 includes a webbing 202 bordered at each outside edge with thicker ridges 204 and 206. These thicker edges are rounded and make the guitar shoulder strap 200 especially comfortable to wear because of the way the weight of the guitar distributes on the user's body. In one implementation that provided very good results and is judged commercially viable, the strap had an overall width (w1) of about fifty millimeters and each ridge 204 and 206 had a width (w2) of about six millimeters. The ridges 204 and 206 had a thickness (t1) of about four millimeters, and the webbing 202 had a thickness (t2) of about two millimeters.

FIG. 3 represents a guitar shoulder strap 300 in cross-section that has been fabricated from a single textile weave in a preferred embodiment of the present invention. The strap 300 includes a decorative side 302 and a wear side 304. The decorative side 302 has warp fibers 306 that run longitudinal with the strap and present a decorative pattern, e.g., warp-facing. The wear side 304 has warp fibers 308. At both opposite side edges, a thickened roll or ridge is formed by respective bunching of a number of warp fibers 310 and 312. A weft thread 314 transversely weaves with the warp fibers and progresses in a spiral along the length of the strap 300.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A guitar should strap, comprising:

a thin, flat strip of material with two opposite outside edges and two opposite ends, and having an inside wear surface for providing a comfortable contact over the shoulder of a user, and an outside decorative surface;

a thickened material along both of said two opposite outside edges that protrudes in a pair of ridges along said two opposite outside edges of said inside wear surface;

a first button loop fastened to one of said two opposite-ends and providing for a first button-attachment of the guitar shoulder strap to a first sling button on a guitar; and a second button loop fastened to another of said two opposite ends and providing for a second button-attachment of the guitar shoulder strap to a second sling button on said guitar( . ); wherein the thin, flat strip of material and the thickened material comprise a single weave of a textile in which transverse fibers spiral in loops along the entire length, and said transverse fibers are interwoven with a first set of longitudinal fibers, and said first set of longitudinal fibers include a decorative pattern on said decorative surface, and said transverse fibers loop at said opposite outside edges around respective bunches of a second and third set of longitudinal fibers to create opposite thick rolled edges.

* * * * *